US006968712B2

(12) United States Patent
Wilkinson

(10) Patent No.: US 6,968,712 B2
(45) Date of Patent: Nov. 29, 2005

(54) PRESSURIZED AIR CHAMBER IN A MAIN FREEZER FOR FLASH FREEZING

(76) Inventor: Ken Wilkinson, 3680 Seltise Way, Unit B, Post Falls, ID (US) 83854

( * ) Notice: Subject to any disclaimer, the term of this patent is extended or adjusted under 35 U.S.C. 154(b) by 6 days.

(21) Appl. No.: 10/816,005

(22) Filed: Apr. 1, 2004

(65) Prior Publication Data

US 2004/0194494 A1 Oct. 7, 2004

Related U.S. Application Data

(60) Provisional application No. 60/459,693, filed on Apr. 2, 2003.

(51) Int. Cl.[7] ..... F25D 17/06
(52) U.S. Cl. ..... 62/408; 62/416
(58) Field of Search ..... 62/255, 407, 408, 62/418

(56) References Cited

U.S. PATENT DOCUMENTS 2,305,075 A * 12/1942 Gilpin ..... 62/418
4,339,928 A 7/1982 Guibert
5,277,039 A 1/1994 Haasis
5,902,618 A 5/1999 Haasis, Jr.
6,073,458 A * 6/2000 Kim ..... 62/186
6,220,049 B1 * 4/2001 Lajeunesse ..... 62/440
6,263,693 B1 * 7/2001 Gladd, Sr. ..... 62/418
6,422,031 B1 * 7/2002 Mandel et al. ..... 62/408
2003/0080126 A1 5/2003 Voute et al.

FOREIGN PATENT DOCUMENTS

JP 5-332665 * 12/1993

* cited by examiner

*Primary Examiner*—William E. Tapolcai
(74) *Attorney, Agent, or Firm*—John S. Reid; Reidlaw, L.L.C.

(57) ABSTRACT

A flash freezer and process is described in which a freezer cabinet is configured to be positioned within the refrigerated air compartment of a primary freezer. An internal flash freeze compartment is located within the cabinet next to a plenum which is separated from the flash freeze compartment by a bulkhead. A plurality of first air passage apertures is formed through the bulkhead to permit passage of air between the flash freeze compartment and the plenum. A plurality of second air passage apertures is formed through a cabinet wall opposite to the bulkhead. The air passage apertures are arranged to control passage of refrigerated air under pressure from the refrigerated air compartment to direct a uniform pressurized airflow through the flash freeze compartment and over the articles placed therein.

5 Claims, 6 Drawing Sheets

PRESSURIZED AIR CHAMBER IN A MAIN FREEZER FOR FLASH FREEZING

CROSS REFERENCE TO RELATED APPLICATIONS

This application claims priority under 35 U.S.C. § 120 to U.S. Provisional Patent Application Ser. No. 60/459,693, filed Apr. 2, 2003 and entitled, "Pressurized Air Chamber in a Main Freezer for Flash Freezing Blood Plasma, Blood, Drugs and the Like", which is hereby incorporated by reference herein in its entirety.

FIELD OF THE INVENTION

The invention claimed and disclosed herein pertains generally to refrigeration and more particularly to quick or flash freezing apparatus and processes for flash freezing within existing freezer compartments.

BACKGROUND

The term "Flash Freezing" generally refers to a refrigeration process that will quickly freeze a product. It is desirable to be able to quick-freeze many different materials but particularly biological or medical materials, in order to avoid deterioration or to place the material quickly into condition for transport or use.

Some forms of prior flash freezers make use of liquid bath to facilitate quick freezing. However, this requires liquid handling, which is undesirable. Further the liquid typically used in flash freezing processes is expensive and the mechanisms used to circulate the liquids are expensive and maintenance intensive.

Extreme low temperature "walk in" type freezers are also used for flash freezing. Such freezers are made to operate at sub-zero temperatures and provide adequate but non-uniform freezing times. Articles placed at different locations within the freezer compartment can have significantly different freezing times.

A need is therefore realized for a fast acting freezer that can make use of existing conventional freezer technology without using liquid, liquefied gases or other materials other than air.

Another problem with typical flash freezers is that the freezer unit is typically a stand alone, single function unit that cannot be used for other than flash freezing materials. Often a walk-in type conventional freezer is provided in the same laboratory or facility where the flash freezer is located, and takes up physical space in addition to the space occupied by the flash freezer.

Attempts have been made in the past to combine the function of a conventional refrigeration unit to facilitate flash freezing. However such units have not been satisfactory in that the freezing fluids are typically not appropriately circulated to assure uniform freezing times.

The present invention, as will be understood below, provides a new and nonobvious solution to the above problems. And, while achieving the benefits derived from other known methods and devices, the present invention avoids the shortcomings and detriments individually associated therewith.

SUMMARY

One embodiment of the invention provides for a flash freezer that is usable within a primary freezer having a refrigerated air compartment. The flash freezer includes a freezer cabinet that is formed by peripheral cabinet walls and defines an internal flash freeze compartment. The freezer cabinet is configured for positioning within the primary freezer and exposed to the refrigerated air therein. A plenum is located within the cabinet adjacent to the flash freeze compartment and is separated from the flash freeze compartment by a bulkhead. A plurality of first air passage apertures is formed through the bulkhead to permit passage of air between the flash freeze compartment and the plenum. A plurality of second air passage apertures are formed in one cabinet wall that is disposed across the flash freeze compartment from the bulkhead. The second air passage apertures are in at least approximate alignment across the flash freeze compartment with the first air passage apertures. An air mover is connected to the plenum and operates to move refrigerated air under pressure from the refrigerated air compartment through the first and second air passage apertures, with the first and second air passage apertures acting to direct a uniform pressurized air flow through the flash freeze compartment.

In another aspect, the invention includes a combination with a primary freezer having a refrigerated air compartment defined by insulated walls and a primary access. A freezer cabinet is configured for positioning within the primary freezer, for exposure to refrigerated air therein. A plenum within the cabinet is situated adjacent the flash freeze compartment and is separated from the flash freeze compartment by a bulkhead. A plurality of first air passage apertures are formed through the bulkhead to permit passage of air between the flash freeze compartment and the plenum, and a second plurality of apertures are provided in one cabinet wall that is disposed across the flash freeze compartment from the bulkhead. The second air passage apertures are in at least approximate alignment across the flash freeze compartment with the first air passage apertures. An air mover connected to the plenum is operable to move refrigerated air under pressure from the refrigerated air compartment, through the first and second air passage apertures. The apertures and air mover act together to direct a uniform pressurized airflow through the flash freeze compartment. The freezer cabinet is positioned adjacent one of the insulated walls with the first and second air passage apertures oriented to direct the airflow substantially parallel to the one insulated wall. An access door in the one insulated wall permits access to at least one door in the cabinet, which can be opened to expose the flash freeze compartment from outside the primary freezer.

A further aspect of the invention provides for a process for flash freezing an array of articles within a refrigerated air compartment of a primary freezer. The process includes providing a freezer cabinet capable of placement within the refrigerated compartment and a flash freeze compartment within the cabinet for receiving the array of articles. The process also includes locating a plenum chamber to one side of the flash freeze compartment and producing an airflow of the refrigerated air through the plenum chamber and flash freeze compartment in a prescribed direction. Further included is the step of controlling the air to flow in a uniform manner about the array of articles; and producing a pressure within the flash freeze compartment that is different from ambient air pressure within the refrigerated air compartment.

The above and further aspects and embodiments will next be described in detail with reference to the accompanying drawings which, taken along with the following detailed description and claims, disclose the best mode presently known for carrying out the invention.

DETAILED DESCRIPTION

Figure 1:
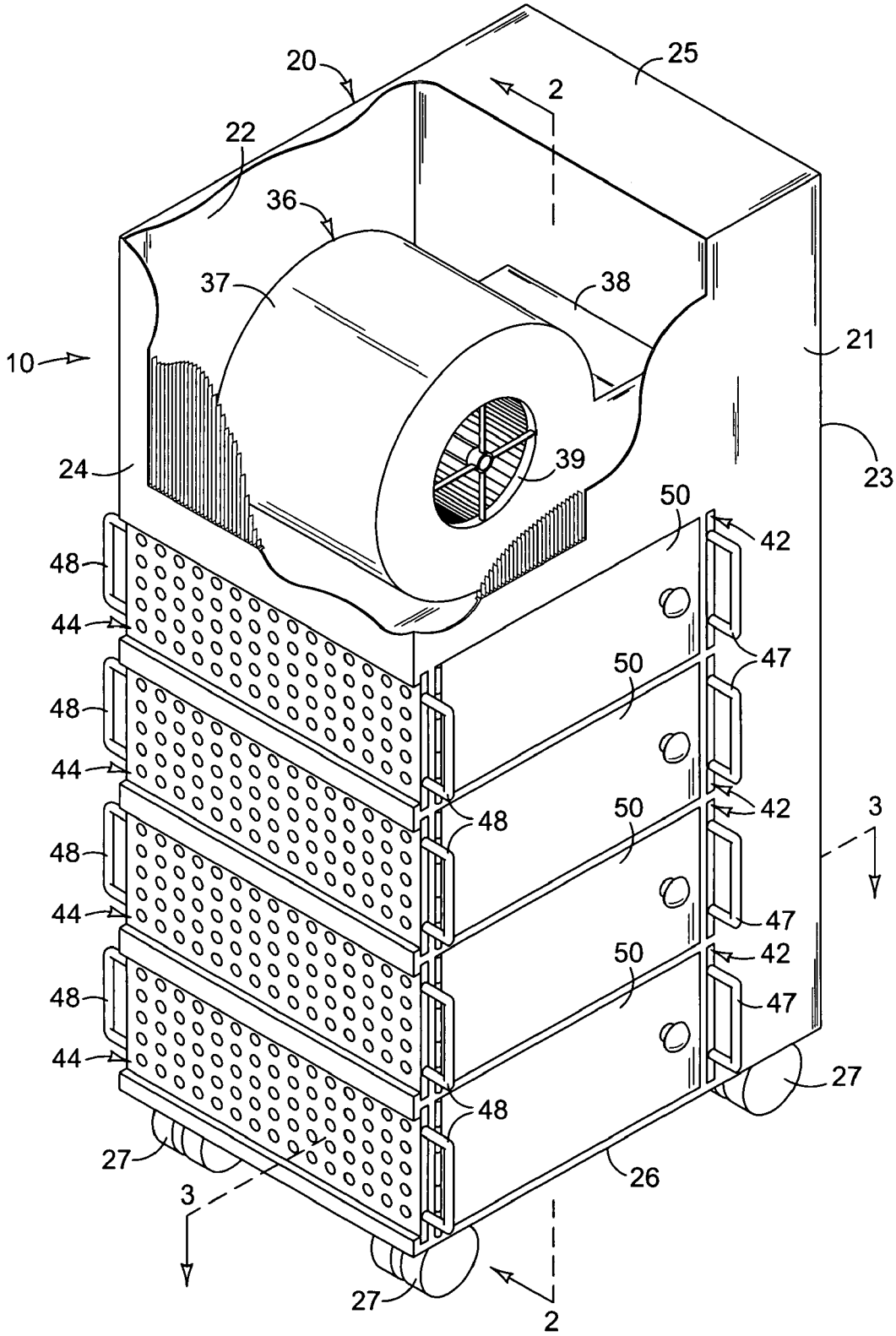
FIG. 1 is a perspective view of an embodiment of the present invention.

Looking now to the drawings in greater detail, attention is first drawn to FIGS. 1–6 and 9 where exemplary representations are made depicting embodiments of my flash freezer, which is generally designated therein by the reference numeral 10. Other exemplary preferred embodiments of the freezer 10 are shown by way of example in the remaining drawings. It is pointed out that all embodiments in accordance with the present invention share aspects that are common and which will therefore be assigned like reference numerals, and description of common features of one embodiment will suffice for description of others in order to avoid undue repetition.

Figure 6:
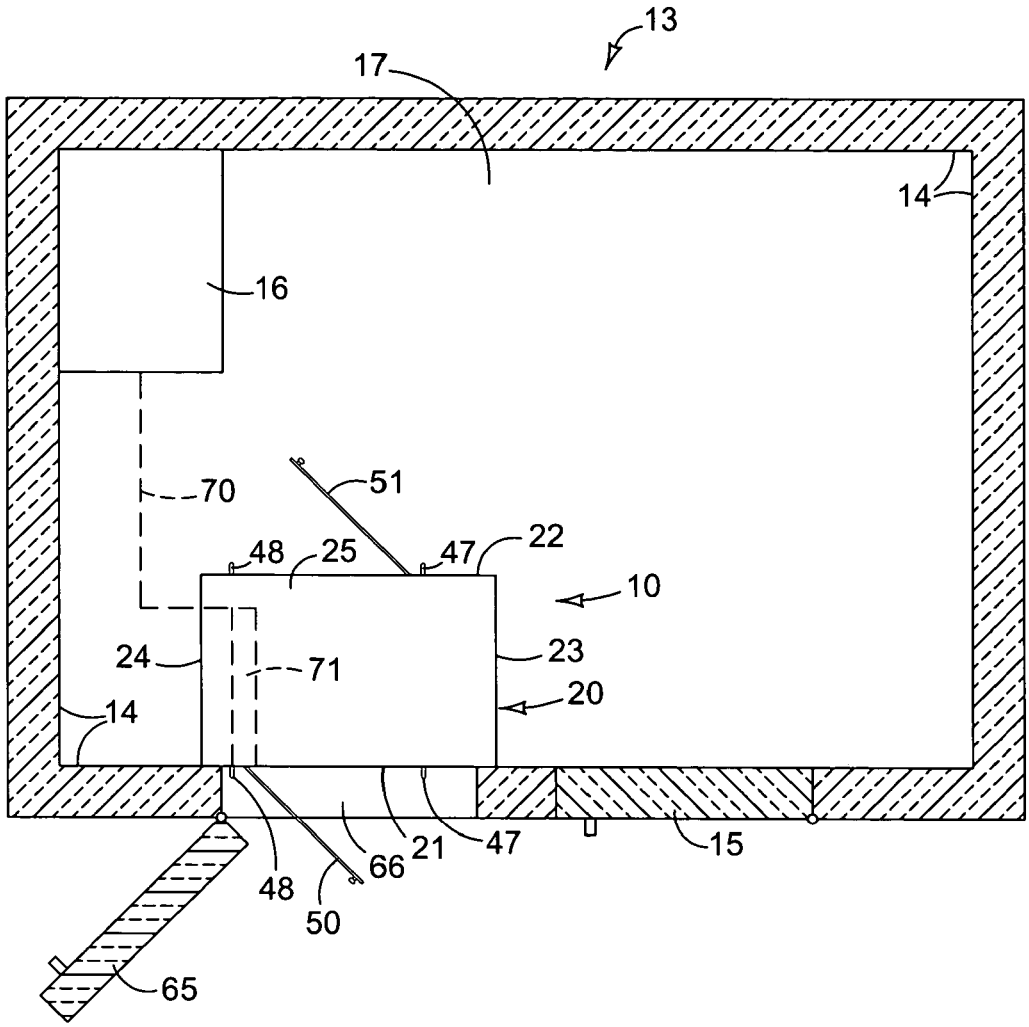
FIG. 6 is a sectioned plan view depicting exemplary flash freezer and primary freezer embodiments in accordance with the present arrangement.

The present invention has utility in flash freezing articles 11 (shown by way of example in FIGS. 2, 3 and others) that are arranged in one or more prescribed arrays, using the refrigerated air of a primary freezer 13 (FIG. 6). The nature of the articles 11 can vary, but particular advantage is found in the medical and biological areas where quick uniform freezing is needed. Blood plasma, for example is typically stored in plastic bottles of uniform shape, and near simultaneous flash freezing of multiple bottles is very desirable step in maintaining high quality product standards. Examples of plasma bottles are shown herein although it should be understood that the nature of the articles to be frozen can vary, from medical or biological specimens to foodstuffs or other articles to be frozen.

Forms of the present invention are intended to be used within a primary freezer 13 (FIG. 6), and as such can be removably situated within the primary freezer 13; attached to the primary freezer as a retrofit modification, or be manufactured as an integral part of a primary freezer.

A primary freezer 13 is diagrammatically represented in FIG. 6 and, as stated above, can be independent of or provided in combination with the flash freezer 10. The primary freezer in preferred forms can be a walk-in type sub zero freezer, defined in part by surrounding insulated walls 14 and accessible by way of a door 15. An evaporator portion of a conventional refrigeration unit 16 can be mounted within the refrigerated air compartment 17 where subzero temperatures are maintained at a selected level.

Figure 8:
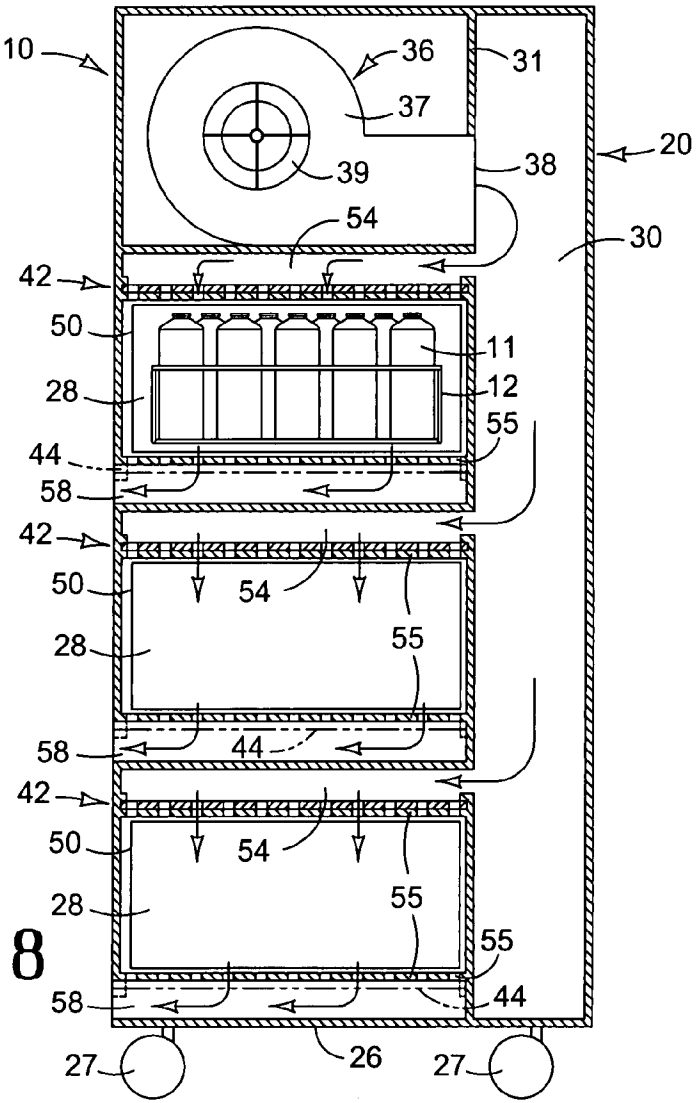
FIG. 8 is another side elevation sectioned view depicting an additional embodiment in accordance with the present invention.
Figure 9:
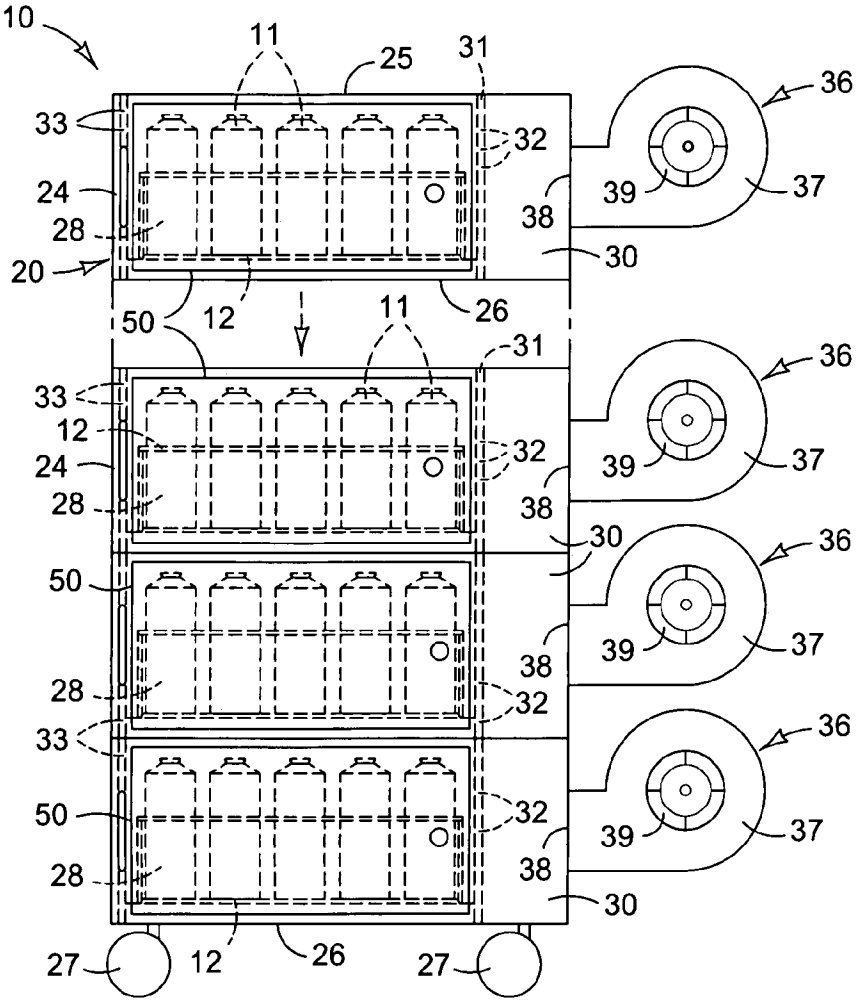
FIG. 9 is a partially exploded view depicting an embodiment in accordance with the present invention.

FIG. 9 depicts, in diagrammatic form, a flash freezer 10 that embodies basic elements of the invention and is intended for placement within a primary freezer such as described above. Actually, several of the freezer units 10 shown in FIG. 9 in a stacked relationship are substantially equivalent to other illustrated embodiments with the exception that individual air movers 36 are provided on each unit, whereas other configurations (see, for example, FIGS. 1, 2, 7, 8, and 10) make use of single air movers 36 for multiple flash freeze compartments 28.

In general terms, aspects of the flash freezer 10 include a cabinet 20 (exemplified in FIGS. 1–3 and others) that is defined by a front wall 21, a back wall 22 an end wall 23, and one wall 24 that is in spaced opposition to wall 23. The cabinet 20 can also have a top 25 and a bottom 26, which is depicted in several of the drawings as being movably supported by castor wheels 27. The wheels enable the cabinet 20 to be moved about, into and out from the primary freezer 13. No wheels need be supplied in aspects wherein the flash freezer 10 is made to be integral with the primary freezer 13.

Figure 2:
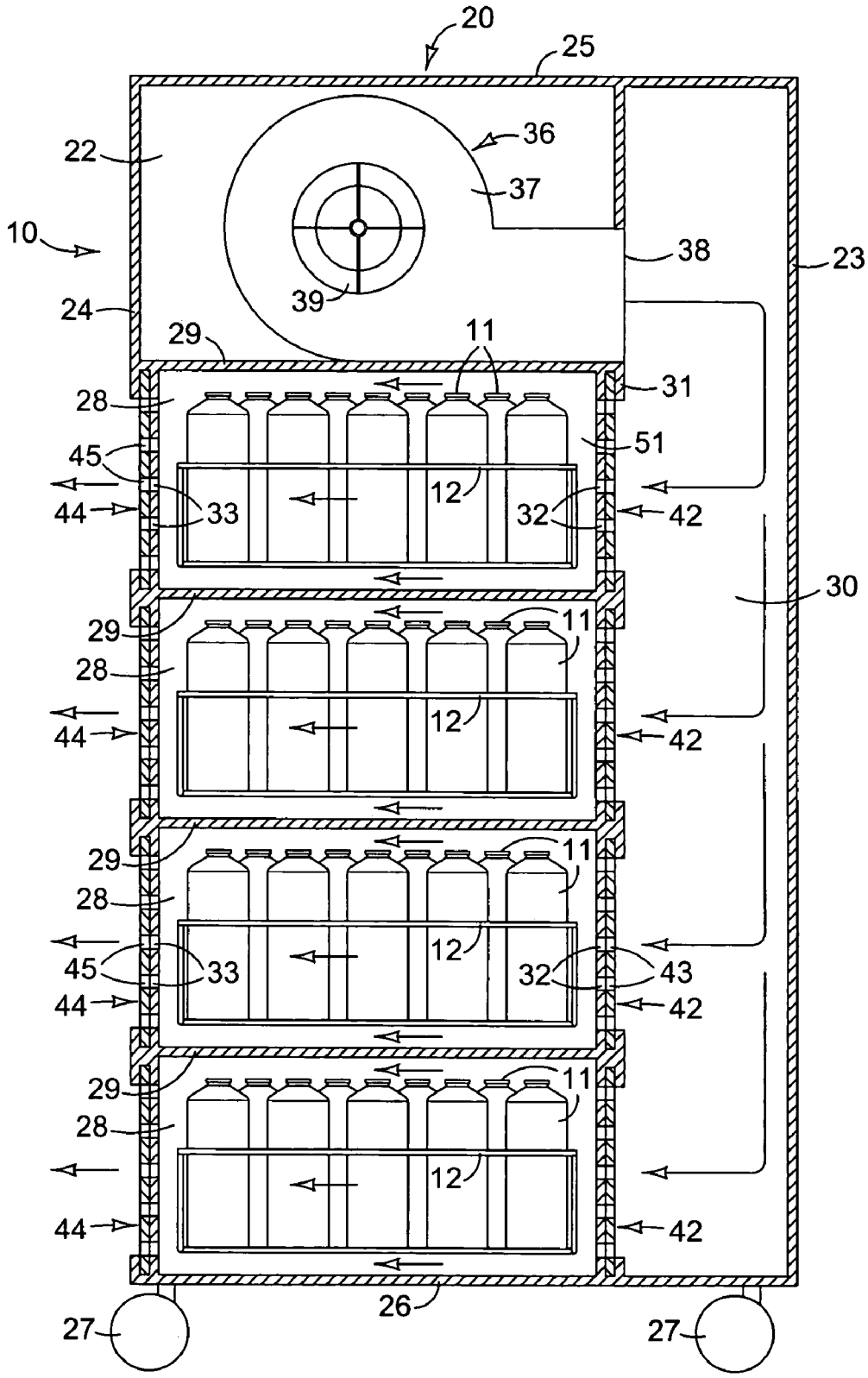
FIG. 2 is a sectional view taken substantially along line 2—2 in FIG. 1; I

As depicted, the above-recited walls 21–24 enclose at least one flash freeze compartment 28 (several of which are illustrated in FIG. 2) that is adapted to receive articles for freezing. Each compartment 28 can be defined within the cabinet 20 by at least one partition wall 29 (which in the FIG. 9 depicted embodiment can be coincidental with the top and bottom walls 25, 26), the end wall 24, and a bulkhead 31. The bulkhead 31 exemplified in FIG. 2 is depicted as being spaced inboard, toward the one wall 24 from the end wall 23 such that the compartment or compartments 28 are on one side of the bulkhead 31 and a plenum 30 is formed on an opposite side of the bulkhead 31.

The plenum 30 can take various shapes according to the number and configuration of the adjacent compartment or compartments 28. For example, as depicted in FIG. 2, the plenum 30 is substantially elongated to provide air under pressure to several compartments 28 simultaneously. As depicted in FIG. 9, the configuration of plenum 30 is such that only a single compartment 28 is served because each of the stacked freezer units 10 has its own air mover 36. By way of further example, in the FIG. 10 aspect, a single top plenum 60 is provided immediately below the top wall 25 to serve the several compartments 28 below. Another example used to illustrate versatility of choice for plenum shape and placement is depicted in FIG. 8 where plenum branches 54 lead over successive flash freeze compartments 28 to supply a substantially vertical uniform airflow through the associated compartments 28.

Note is made that whatever plenum configuration is used, a uniform volume of air is presented by way of the plenum 30, against the adjacent wall 23. This assures an essentially even airflow through a plurality of first air passage apertures 32 that are formed through the wall 23.

The first air passage apertures 32 (see exemplary plan view in FIG. 3) are depicted as being evenly spaced along one side of each flash freeze compartment 28. A matching set of second air passage apertures 33 are formed in the wall 24 opposite the apertures 32.

As illustrated, the number, size, and spacing of the apertures 32 match the number, size, and spacing of the apertures 33. Further, the exemplary apertures 32 align with the apertures 33 across the flash freeze compartments. The apertures 32, 33 in this matching relationship encourage substantially laminar airflow through the flash freeze compartments 28 so that uniform, even surface contact is encouraged between the moving air and the articles held within the compartments. However, it should be understood that the apertures 32 and 33 do not necessarily need to correspond in number, size and spacing.

Figure 3:
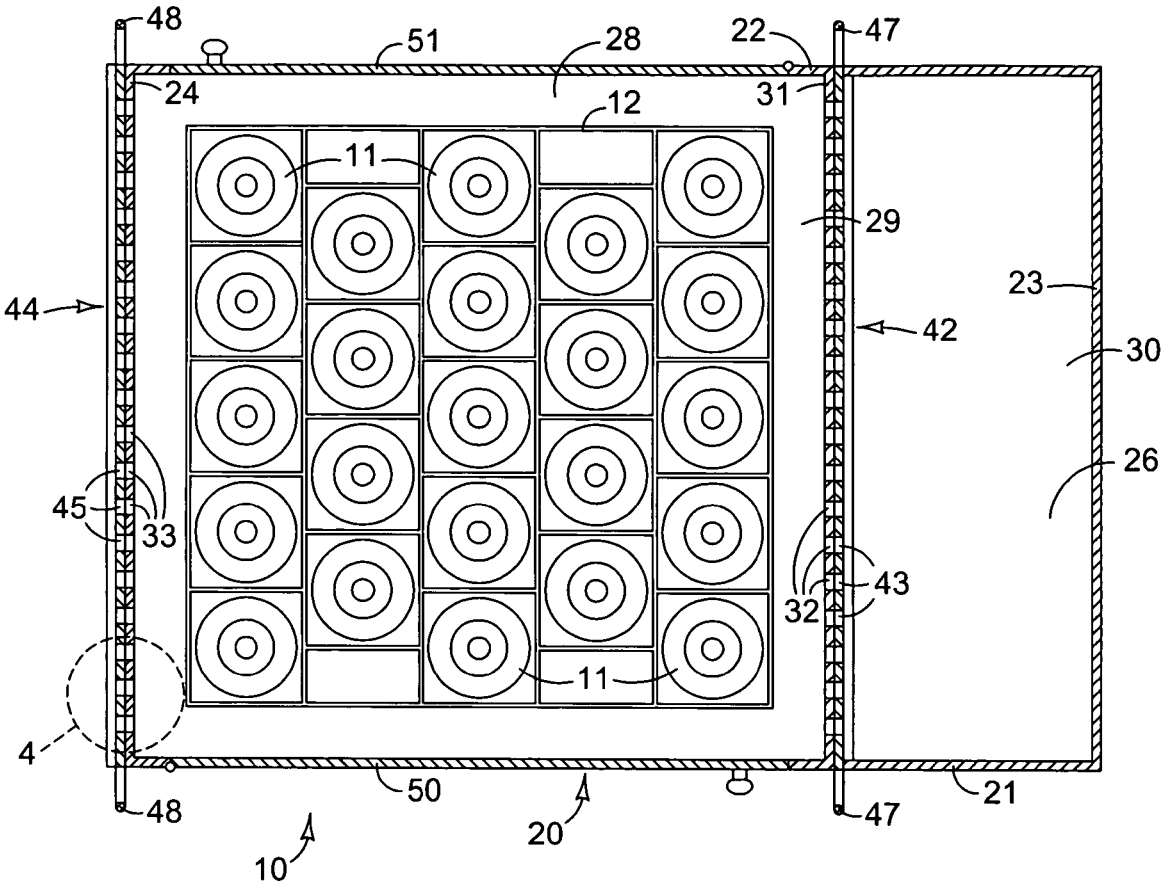
FIG. 3 is a sectional view taken substantially along line 3—3 in FIG. 1.

It is noted that in various aspects (see examples in FIGS. 2, 3, and 7–10), the present freezer 10 can be provided with one or more racks 12 for organizing the articles 11 in prescribed arrays. In one preferred arrangement, the racks 12 are configured to support material or articles in an array in which several rows of articles 11 are arranged in spaced and staggered fashion. FIG. 3 shows an exemplary arrangement in plan view, where the array of articles 11 are shown in a manner conducive to even airflow and maximum surface contact between the articles and refrigerated air that is forcibly moved through the array. The illustrated racks 12 can be made of welded wire or other rigid materials that can be made to hold the articles 11 in the prescribed arrangement.

Figure 7:
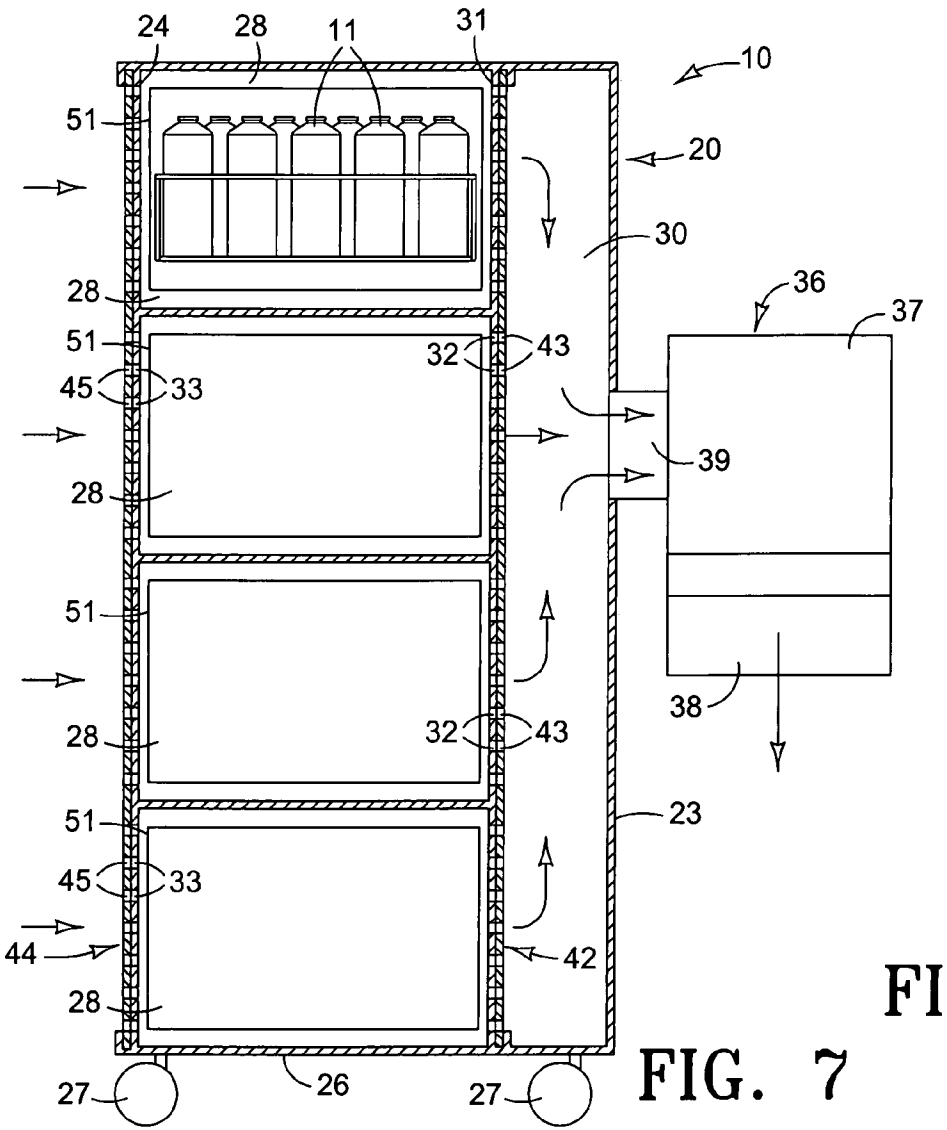
FIG. 7 is a side elevation sectioned view depicting another embodiment in accordance with the present invention.

The air mover 36 in accordance with the invention is used to produce a pressure differential between the flash freezer compartment or compartments 28 and the ambient atmosphere. This pressure differential can be positive or negative. For example, a high static fan or blower 37 can be used as illustrated in FIGS. 1, 2 and 8–10 with its discharge 38 opening into the associated plenum. Operation of the high static fan 37 will thus result in production of high pressure, high velocity movement of refrigerated air that will flow through the associated flash freeze chambers. FIG. 7, on the other hand, exemplifies use of a similar high static fan, but with its intake 39 connected to the associated plenum 30. In this variation, the air mover 36 will produce a negative pressure within the plenum 30 in order to draw air under negative pressure through the airflow apertures 32, 33 and across the associated flash freeze compartments 28. In either instance, air is drawn from the immediate atmosphere and is moved at high velocity and uniformly through the compartments 28. When the cabinet 20 is disposed within a primary freezer 13 (as depicted in FIG. 6), the air will be refrigerated and heat from the evenly spaced articles 11 within the flash freeze compartments will be quickly and evenly absorbed by the moving air and the freezing process will be accomplished very nearly simultaneously for all articles within the cabinet.

Steps involved in loading and unloading of the flash freeze compartments 28 can be accomplished through at least one access door 50 (FIGS. 1, 3, 6, and others) that can be provided in one of the cabinet walls. In the illustrated example, two access doors 50, 51 are provided in respective walls 21, 22 to allow for access from either or both opposed sides. A rack of articles 11 can be inserted into or removed from a selected flash freeze compartment 28 simply by opening a selected door 50, 51 and manually inserting or removing the rack 12. Articles 11 can then be loaded into or removed from the rack 12 as desired.

It is noted that the door or doors 50, 51 are provided on walls that are adjacent to the apertured walls as exemplified in FIG. 3, so the airflow through the compartments 28 will be substantially parallel to the doors. This is done to allow for positioning of the cabinet 20 directly adjacent to a primary freezer wall 14 without inhibiting airflow through the cabinet. One of the walls 21 or 22 can thus be in almost flush engagement with a primary freezer wall as depicted in FIG. 6, and airflow through the cabinet will not be affected. Airflow will be parallel to the primary freezer wall and access to the flash freeze compartments will be available through at least one of the doors 50, 51.

Airflow through the compartments 28 can be controlled by provision of isolators 42 (FIGS. 3–5 and others) which can be selectively operable to open or close the first and/or second air passage apertures 32, 33. Alternatively, where no isolators are provided, air control can also be accomplished by selective on-off operation of the air movers 36. However in aspects of the invention in which multiple flash freeze compartments are served by a single air mover 36 (as demonstrated in the FIGS. 2 and others), individual control of the airflow through the compartments can become desirable.

Isolators 42 can be provided in the form of plates that are slidably mounted to the cabinet 20 directly adjacent to at least one set of air passage apertures 32. FIG. 3 exemplifies two such isolators 42 and 44; one for each set of air passage apertures 32, 33. Sets of holes 43, 45 that match the size and pattern of respective air passage apertures 32, 33 can be provided in the isolators 42, 44.

Figure 4:
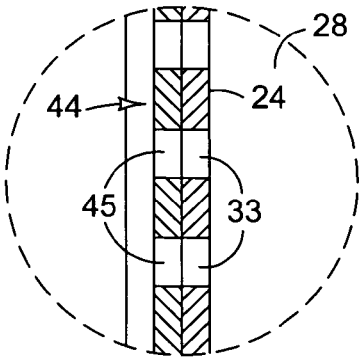
FIG. 4 is an enlarged fragment of an area identified at 4 in FIG. 3.
Figure 5:
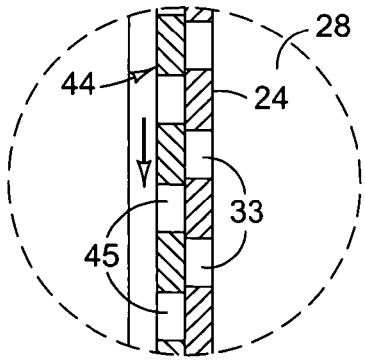
FIG. 5 is a view similar to FIG. 4 only showing a different operational position.

FIGS. 4 and 5 depict fragments of the wall 24 and adjacent isolator 44. FIG. 4 shows the isolator 44 in an open position in which the adjacent air passage apertures 33 are fully open and air is permitted to flow freely into or out from the adjacent flash freeze compartment 28. FIG. 5 shows the isolator 44 in a closed position in which the adjacent air passage apertures 33 are fully closed, blocking passage of air to or from the adjacent flash freeze compartment 28.

It is noted that individual apertures 33 (FIGS. 4 and 5) are opened or closed simultaneously upon movement of the associated isolator 44. This is a function of the matching apertures 33 and 45 in the respective wall 24 and isolator 44, by which the even, substantially laminar airflow is assured even if the isolator is positioned to partially close the air passage apertures 33. Each aperture 33 will be obstructed to the same degree, so airflow will remain even although reduced. This function thus assures that the even, substantially laminar airflow will not be disrupted up to such time that the airflow is fully stopped as depicted in FIG. 5. Also, uniform, substantially laminar flow begins immediately as the isolator 44 is shifted to the open position because all of the air passage apertures 33 are opened simultaneously.

Movement of the isolators 42, 44 can be independently initiated by provision of handles 47, 48 (see FIGS. 1, 3 and 6) on opposite ends of the respective isolators 42, 44. The handles 47, 48 can be formed of a low heat transmissive material such as neoprene in order to reduce frosting from use in the cold primary freezer atmosphere.

It is noted that in basic forms of the freezer 10 (such as depicted in FIG. 9 as single flash freezer units), that isolators are optional. This is because airflow is controlled by individual air movers 36, and control can be maintained simply by turning selected air movers 36 off and on. In other forms, one or more isolators can be provided. For example in the FIG. 10 arrangement, one isolator 63 is used to control airflow through multiple flash freeze compartments 28. These compartments 28 are joined in series as a column, and are open to one another so that opening and closing of the singular isolator 63 at the top of the column will affect airflow through all of the serially connected compartments while the air mover 36 is running.

In the arrangement shown in FIG. 8, an isolator 42 is used on the "high" or pressure side of each compartment 28, and optional isolators 44 are shown by dashed lines on the "low" or discharge sides so that airflow through the various compartments 28 can be controlled individually without affecting airflow through others. The freezer embodiment shown in FIGS. 1–3 is shown in plan view FIG. 6, with two isolators 42, 44 for each compartment. Such paired isolators are useful in the illustrated arrangement in situations as when an auxiliary door 65 in the primary freezer is opened and one or more selected cabinet doors 50 can be opened to allow access to the flash freeze compartments 28. The paired isolators 42, 44 can both be closed in this situation (before the associated cabinet door 50 is opened), to not only selectively block inflow of air from the air mover 36 into the exposed flash freeze compartment, but to help minimize infiltration between the primary freezer compartment 17 and the outside atmosphere.

Referring now in particular to FIG. 8, the freezer 10 is shown with the same or variations of the elements described above. In the illustrated example, the plenum 30 includes the plenum branches 54, which extend horizontally above successive elevationally disposed flash freeze compartments 28. Air from the mover 36 is received within the main plenum 30 and is directed under evenly distributed pressure to the individual plenum branches 54. Horizontally disposed, perforated bulkheads 55 are provided, defining the first and second air passage apertures, by which airflow is controlled through the associated flash freeze compartments 28. Air thus enters through the plenum branches 54, passes in a substantially uniform laminar flow through the top bulkheads 55, travels downwardly through the bottom bulkheads 55, and exits out through associated discharge plenums 58. One or two isolators can be provided for each flash freeze compartment to accomplish the selective isolation function described above. Doors 50 can be provided to permit access to the compartments 28 for loading and unloading articles 11.

Figure 10:
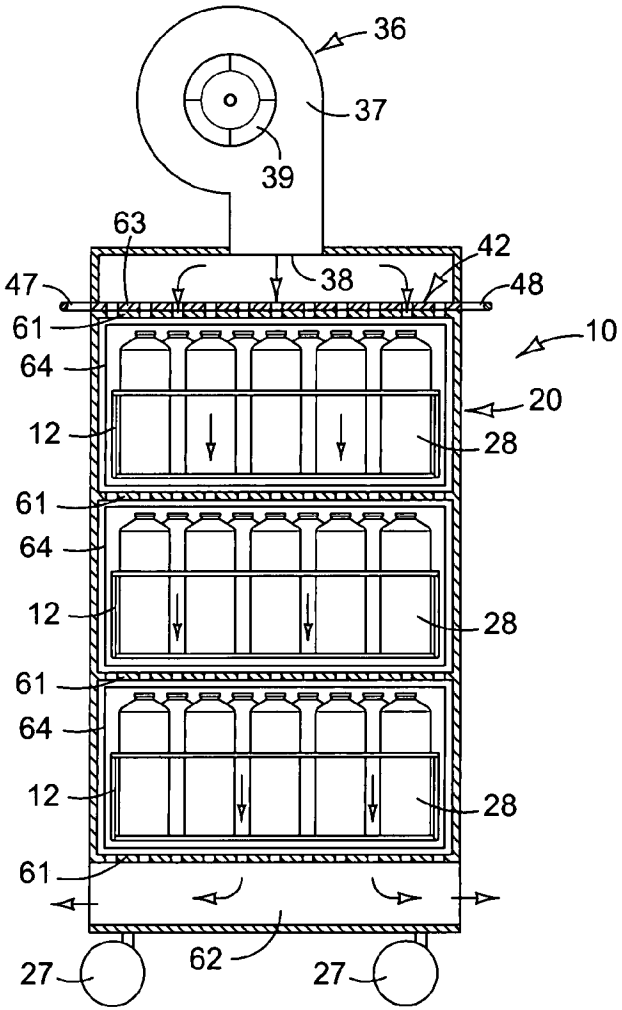
FIG. 10 is a side elevation sectioned view depicting a further embodiment in accordance with the present invention.

Referring now in particular to FIG. 10, a top plenum 60 is depicted and is connected to an air mover 36 to evenly distribute air under pressure to a succession of flash freeze compartments 28. This configuration makes use of bulkheads 61 with matching air passage apertures 59 that are similar or identical to those described above. Air is forced by the air mover 36 downwardly through the plenum 60 and through the air passage apertures 59 in the successive bulkheads 61, and subsequently through the vertically disposed array of compartments 28 to a single bottom discharge 62. The single isolator 63 at the top of the compartment column is operable to open or close air passage through all the compartments 28 below. Thus, when the isolator 63 is closed, essentially no air movement will occur in any of the compartments 28, and the associated doors 64 can be opened individually or in numbers to access the contents.

It is noted that the various cabinet configurations exemplified above can be produced without insulation in any of the walls, doors or related structure. By producing the cabinets 20 of not only un-insulated but heat transmissive material, the whole structure can be quickly cooled to the ambient temperature within the primary freezer compartment 17 (FIG. 6). This is done so the walls, bulkheads, etc. do not detract from uniform cooling of adjacent articles during the flash freezing process. Otherwise, the walls and adjacent articles can warm the refrigerated air more than that part of the airflow moving through the central portion of the article array, with the result being that articles inside the article arrays will be frozen faster than articles adjacent the internal cabinet surfaces. Further, an un-insulated cabinet 20 can be utilized without operation of the air mover 36, as a storage device inside the primary freezer once the flash freeze process is complete.

Referring now to FIG. 6, the combination of flash freezer and primary freezer is shown. It is pointed out that various ones of the above flash freezer configurations can be used in the FIG. 10 combination. It is also noted that supplemental and auxiliary components (which are illustrated by dashed lines in FIG. 6) can be used along with one or more of the selected flash freezer configurations.

In retrofit situations, an appropriate wall 14 of the primary freezer 13 (FIG. 6) can be remodeled to include an auxiliary door 65, in addition to the normal freezer door 15. The door 65 can be made within an opening 66 that is cut or otherwise formed in the insulated wall in a configuration that will permit access to a cabinet 20 that has been placed in the primary freezer compartment 17. The opening 66 can be sized to permit positioning of the cabinet 20 with isolator handles 47, 48 exposed therein and projecting toward the door 65. The opening 66 can also be sized to permit access to all the compartment doors 50. With this arrangement, articles 11 and article racks 12 can be placed in the flash freeze compartments 28 without requiring that the user enter the primary freezer compartment 17.

It is noted also that the combination described above can be produced during initial manufacture. The opening 66, door 65 (FIG. 6) and other features can be formed during initial construction of the primary freezer unit 13. Thus, aspects of this invention can be provided as a retrofit arrangement where an existing primary freezer 13 is modified to include the door 65 and opening 66, or during initial manufacture.

Still referring to FIG. 6, aspects that can be included to provide auxiliary or supplementary cooling are illustrated by dashed lines. For example, supplemental ducting 70 can be provided when it is desired to receive cooling air directly from the refrigeration unit 16. The ducting 70 can be made to direct air to the intake side 39 (FIG. 2) of the air mover 36 in instances where the air mover is mounted to direct air under positive pressure through the cabinet 20, or to the plenum 30 in instances where the air mover is mounted to pull air under negative pressure through the cabinet (as in the FIG. 7 arrangement). A loose connection can be made between the ducting 70 and cabinet 20 to allow for movement of the cabinet into and out from the primary refrigeration air compartment 17.

FIG. 6 also depicts a supplemental cooling unit 71 that can be added with or without the ducting 70 to reduce uniform freeze time even further. The supplemental unit 71 can be attached to the ducting 70 and remain within the primary freezer, or with appropriate fittings, could be mounted to the cabinet 20. In either instance, the supplemental refrigeration unit 71 can be used to further assist the flash freeze process, especially within primary freezers where the existing refrigeration is inadequate to enable a desirable freezing time.

The present process for flash freezing an array of articles 11 within a refrigerated air compartment of a primary freezer 13 can generally include providing a freezer cabinet 20 substantially as described above with the plenum chamber 30 located as exemplified, and with the flash freeze compartment 28 as described. The cabinet, plenum chamber and flash freeze compartment can all be formed using conventional sheet metal construction techniques well known to those of ordinary skill in the art of sheet metal work and refrigeration equipment fabrication. A conventional high static fan can be mounted to the cabinet as the air mover 36, and be provided with appropriate conventional controls (not shown) to selectively produce a forced high pressure and high velocity airflow through the selected cabinet 20 and the flash freeze compartment or compartments provided therein.

Loading articles into the cabinet 20 can be accomplished from within the primary freezer (see FIG. 6), or the cabinet 20 can be rolled outside the primary freezer for loading. In either instance, an appropriate door of the cabinet 20 can be opened to gain access to the interior flash freeze compartment. If an empty rack 12 is found inside, the user might wish to remove the rack through the open compartment doorway, load the rack with articles for freezing, and place the loaded rack back into the flash freeze compartment.

By loading the rack as described, the user is assured that the articles will be spaced apart evenly and in staggered rows for maximum surface exposure to refrigerated airflow within the cabinet. Several racks can be loaded in this manner, one for each of the flash freeze compartments in the cabinet as shown by the example illustrated in FIG. 2 and others). The racks 12 can be loaded, placed within the flash freeze compartments, and the cabinet can be rolled into the primary freezer 13, at which point the air mover 36 can be actuated. The freezing process will begin as refrigerated air from within the primary freezer is moved past the articles within the cabinet.

Alternatively, in situations where the primary freezer is provided with an auxiliary door 65 (as in FIG. 6), there is no need to first remove the cabinet 20 from the primary freezer for loading. Instead, access to the racks 12 can be gained from outside the primary freezer 13 as shown in FIG. 6. To accomplish loading, the door 65 is opened to expose the flash freeze compartment doors 50. Any one or more of these doors 50 can be opened to gain access to the flash freeze compartments 28. Racks 12 loaded with articles 11 can be loaded into the compartments 28, the doors 50 and 65 can be successively closed and the air mover can be actuated (or allowed to remain operating if previously actuated) to freeze the articles with refrigerated air from inside the primary freezer 13.

In instances where it is desirable to isolate the flash freeze compartments from the primary freezer interior, the isolators 42, 44 or 60 can be used (see exemplary operation in FIGS. 4 and 5). Whatever isolators are provided can be shifted (prior to opening the associated door 50) to close the air passage apertures 32, 33, and thereby block air passage through the compartments 28. By doing this, the air mover can remain in operation to move cooling air through other flash freeze compartments, and the user will not be faced by a blast of freezing air once the door 50 is opened. This is beneficial especially if the cabinet is being accessed from outside the primary freezer through the doorway 66 (FIG. 6). Closing the air passage apertures before opening the associated door 50 in this circumstance will prevent loss of refrigerated air from the refrigerated air compartment 17, and the air mover 36 can continue to move refrigerating air through those compartments 28 where the isolators remain in an open condition and the doors are closed.

In configurations where additional doors 51 are located on opposite sides of the cabinet (see example in FIG. 6) loading can be accomplished from outside the primary freezer 13 as described, and unloading of frozen articles 11 can be accomplished from within the primary freezer compartment 17. Time spent within the primary freezer compartment 17 will therefore be minimized. Also, there will be a substantial reduction in the number of times the freezer door 15 must be opened. Flash frozen articles 11 can be removed from the cabinet 20 and be placed within the primary freezer 13 to make room for a fresh array of articles to be placed in the cabinet for flash freezing. The isolators can be used in this step as well, to prevent emission of a blast of cold air as the door 51 is opened. Undesired fogging and frosting within the cabinet 20 and, for that matter, within the primary freezer 13, will also be minimal as compared to prior situations where articles are simply moved into and removed from the primary freezer 13.

The apparatus and steps described above attain the objective of uniformly freezing articles almost simultaneously within the cabinet 20 due to forced substantially laminar flow of refrigerated air moving under pressure, in a prescribed direction and at high velocity through the array of articles 11. The refrigerated air will intimately contact the spatially organized articles 11 within the flash freeze compartments 28 and heat will be uniformly transferred to the moving air. The articles will therefore freeze at an essentially uniform rate.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A flash freezer for use within a primary freezer having a refrigerated air compartment, the flash freezer comprising:

a freezer cabinet formed by peripheral cabinet walls and defining an internal flash freeze compartment;

the freezer cabinet being configured to be positioned within and exposed to refrigerated air within the refrigerated air compartment of the primary freezer;

a plenum within the cabinet adjacent the flash freeze compartment and separated from the flash freeze compartment by a bulkhead;

a plurality of first air passage apertures formed through the bulkhead to permit passage of air between the flash freeze compartment and the plenum;

wherein one cabinet wall is disposed across the flash freeze compartment from the bulkhead;

a plurality of second air passage apertures formed through the one cabinet wall;

an air mover connected to the plenum and operable to move refrigerated air under pressure from the refrigerated air compartment, through the first and second air passage apertures, with said first and second air passage apertures acting to direct a generally uniform pressurized air flow through the flash freeze compartment;

isolation plates slidably mounted on the freezer cabinet adjacent the first and second air passage apertures to selectively close the first and second air passage apertures and wherein the isolation plates include gate apertures that substantially match the first and second air passage apertures in size, spacing and number;

wherein the isolation plates are movable into positions in which the gate apertures are in registration with the first and second air passage apertures to permit airflow through all the first and second air passage apertures, and to closed positions out of registration with the first and second air passage apertures to inhibit airflow through all of the first and second air passage apertures; and further comprising handles on the isolation plates projecting from the freezer cabinet to permit manual access to manually move the isolation plates.

2. A flash freezer, comprising:

a primary freezer having a refrigerated air compartment defined by insulated walls and a primary access;

a freezer cabinet configured to be positioned within and exposed to refrigerated air within the refrigerated air compartment of the primary freezer;

a plenum within the cabinet adjacent the flash freeze compartment and separated from the flash freeze compartment by a bulkhead;

a plurality of first air passage apertures formed through the bulkhead to permit passage of air between the flash freeze compartment and the plenum;

wherein one cabinet wall is disposed across the flash freeze compartment from the bulkhead;

a plurality of second air passage apertures formed through the one cabinet wall; and an air mover connected to the plenum and operable to move refrigerated air under pressure from the refrigerated air compartment, through the first and second air passage apertures, with said first and second air passage apertures acting to direct a generally uniform pressurized air flow through the flash freeze compartment;

at least one door in the cabinet;

wherein the freezer cabinet is positioned adjacent one of the insulated walls with the first and second air passage apertures oriented to direct the air flow substantially parallel to the one insulated wall; and an access door in the one insulated wall to permit access to the door in the cabinet and to permit access to the flash freeze compartment from outside the primary freezer.

3. The flash freezer of claim 2, and wherein the second air passage apertures are in at least approximate alignment across the flash freeze compartment with the first air passage apertures.

4. The flash freezer of claim 2, and further comprising a refrigeration unit within the primary freezer and ductwork leading from the refrigeration unit to the freezer cabinet and configured to deliver refrigerated air to the freezer cabinet.

5. The flash freezer of claim 2, further comprising a plurality of the freezer cabinets and air movers releasably stacked in a group.

* * * * *